US011993437B2

(12) United States Patent
Smith

(10) Patent No.: US 11,993,437 B2
(45) Date of Patent: May 28, 2024

(54) APPARATUS FOR SECURING LOADS

(71) Applicant: Detectamet Limited, Pocklington (GB)

(72) Inventor: Sean Ronald Smith, Richmond, VA (US)

(73) Assignee: Detectamet Limited, Pocklington (GB)

( * ) Notice: Subject to any disclaimer, the term of this patent is extended or adjusted under 35 U.S.C. 154(b) by 529 days.

(21) Appl. No.: 17/150,124

(22) Filed: Jan. 15, 2021

(65) Prior Publication Data

US 2021/0221584 A1 Jul. 22, 2021

(30) Foreign Application Priority Data

Jan. 17, 2020 (GB) ..... 2000709

(51) Int. Cl.

| | |
|---|---|
| ***B65D 63/02*** | (2006.01) |
| ***B65D 65/46*** | (2006.01) |
| ***B65D 71/00*** | (2006.01) |
| ***B65D 71/02*** | (2006.01) |

(52) U.S. Cl.

CPC ..... *B65D 63/02* (2013.01); *B65D 65/466* (2013.01); *B65D 71/0096* (2013.01); *B65D 71/02* (2013.01); *B65D 2571/00111* (2013.01)

(58) Field of Classification Search

CPC .. B65D 63/02; B65D 65/466; B65D 71/0096; B65D 71/02; B65D 2571/00111

USPC ..... 206/597

See application file for complete search history.

(56) References Cited

U.S. PATENT DOCUMENTS

| | | | | |
|---|---|---|---|---|
| 2,908,122 | A * | 10/1959 | Allen | B65D 71/02 53/399 |
| 6,138,327 | A * | 10/2000 | Powell | B29C 45/14467 24/298 |
| 2016/0130054 | A1* | 5/2016 | Gao | B29C 35/02 264/331.12 |

* cited by examiner

*Primary Examiner* — Robert Sandy

(74) *Attorney, Agent, or Firm* — GableGotwals

(57) ABSTRACT

The invention to which this application relates to improvements to a retaining band which can be used to securely locate, form and retain a load of items or goods, in one embodiment on a pallet, and thereby retain the said items or goods as a single integral package. The invention allows for the adaptation of the retaining bands to be detectable when with a predetermined range of detection apparatus such as X-ray and/or metal detection apparatus so that should the retaining band or fragments thereof be discarded or dislodged, the presence of the same is detectable and therefore prevented from becoming a potential contaminant or safety hazard.

17 Claims, 1 Drawing Sheet

APPARATUS FOR SECURING LOADS

The invention to which this application relates is to improvements to apparatus of a type which can be used to more securely locate a load of items or goods on a pallet and thereby effectively form the said items or goods as a single integral package which can be moved when located on the pallet, with the pallet providing the base support and also acting as the interface between the movement apparatus such as a forklift truck, and the pallet load.

The use of pallets to move loads of goods between different locations, for example, within a manufacturing facility and/or from the manufacturing facility to a location of use or sale, is well-known. Also well-known is that if the items which are placed together to form the load on the pallet are unstable, then during storage and/or movement, items can fall from the pallet which means that time then has to be taken to relocate the items as part of the load, can mean that items are missing from the load when it is subsequently delivered to the required location and/or can represent a hazard or risk to other personnel in the vicinity of the pallet load when the same starts to move and items fall.

In order to avoid this problem, or at least reduce the risk of the pallet load from being unstable, it is known to provide retaining means which pass round the sidewalls of the pallet load and thereby maintain the sidewalls in respective, substantially vertical planes, perpendicular to the horizontal plane of the pallet base. These retaining means can be temporary in nature such as, for example, in the form of cardboard or thin plastic sheet material wrapped around the same or may be more environmentally friendly and reusable apparatus known as pallet bands.

The pallet bands, in one form, can be expanded and placed in position around the pallet sidewalls and then reduced in size and/or are tightened to a required degree to secure the items in the load together. When it is required to move the items from the load and/or from the pallet, the pallet bands can be released and then reused on another load. This therefore means that the relatively wasteful use of pallet wrapping sheet material, which is provided for a single use only, is avoided and hence prevents the pallet wrapping material from entering the waste chain.

The pallet bands can be made of silicone, rubber or polythene and typically have a degree of elasticity so as to allow the same to be placed in position and, in one embodiment, the elasticity may be sufficient to allow the required retention force to be exerted on the sidewalls of the pallet load or alternatively, tightening means may be provided to allow the pallet band to be tightened around the pallet load sidewalls once placed in position.

However, the potential use of pallet bands in certain environments, such as a food environment, provides further problems in that the pallet band represent a potential contamination source which is introduced into the food environment in an uncontrolled manner and which, if the same breaks, or is discarded, or is damaged, represents an opportunity for the material from which the pallet band has been formed, to enter the food manufacturing process and/or the foodstuff itself. Thus, at present, while the use of pallet bands is recognised as being environmentally beneficial and can be provided in a form which is suitable for use in a non-contaminating manner in terms of the material from which the pallet band is formed, the applicant has recognised that there is a risk of potential contamination of the food manufacturing process and/or food products.

The aim of the present invention is therefore to provide a means whereby the presence of a pallet band and/or fragment of a pallet band can be determined and thereby allow the same to be removed from an environment in which the same would represent a potential hazard such as a food manufacturing environment, whilst ensuring that the advantages of use of the pallet bands can still be achieved.

In a first aspect of the invention, there is provided a retention means for use in retaining a load of items in a defined position, said retention means provided to be located with respect to one or more walls of the said formed load and wherein the said retention means include one or more materials as an integral part thereof which render the said retention means detectable by X-ray and/or metal detection apparatus when within a predetermined range of said apparatus so as to allow the presence of said retention means, or a fragment thereof greater than a predetermined size, to be detected.

In one embodiment, the said material includes particles of a metal or metal alloy of a form which is detectable by metal detection apparatus.

In one embodiment, the said material includes a material which is capable of detection by X-ray detection apparatus and in one embodiment, the material is a barium or similar material.

In one embodiment the said X-ray and/or metal detectable materials are located within the said retention means as an integral part thereof.

Typically, the range and sensitivity of the detection apparatus is as defined by Health & Safety Standards and may vary from region-to-region and the retention means and in particular, the quantity and form of the detectable materials which are provided as part of the retention means, is selected to meet the detection requirements for that location and/or requirements with regard to the size of a fragment of the retention means which is required to be detected and at which distance from the detection apparatus. It will therefore be appreciated that the form of the detectable materials in the retention means and quantity of the same, can be varied to suit particular usage requirements. In one embodiment the detection range is up to 1 metre and the fragment size is greater than 1 $cm^2$ Typically, the retention means are provided in the form of a band of a flexible material and said band is provided to be selectively positioned around the sidewalls of a load of items so as to retain the sidewalls in substantially vertical planes during storage of the said load and the movement of the said load between different locations.

Typically, the load of items is located on a pallet to form a pallet load. Typically the pallet is formed of wood, plastics or cardboard material and which forms the base of the load and provides location means via which movement apparatus, such as a forklift truck, can engage with the load and hence move the same between the required locations.

In one embodiment, the retention means can be provided as a band and may be provided in a range of different sizes and the particular size of band which is used and/or number of bands used are selected with regard to the particular load size.

In one embodiment, the bands are provided with a degree of elasticity and resilience such that the same can be extended to a size to allow the same to be positioned around the said load and, when in position, the release of the band allows the band to resiliently decrease in size to a sufficient extent to exert a gripping force on the sidewalls of the load and hence maintain the same in the required position.

Alternatively, the bands may be provided with a tightening means which, is initially loosened to allow the band to be placed around the load and, when in position, the operation of the tightening means allows the tightening of the band to a sufficient extent so as to exert a gripping force on the sidewalls of the load to maintain the same in the required position.

In one embodiment, the retention means is provided with an indication means to allow different types, uses, or any other feature of the retention means to be distinguished from other pallet bands.

In one embodiment, the indication means may be provided to identify the particular uses which are allowable for the particular retention means.

In another embodiment, the indication means is used to indicate whether the retention means is metal detectable, X-ray detectable or capable of X-ray and metal detection.

In one embodiment the indication means may be the selection of one of a range of colours for the pallet bands. The selection of the particular indication means, such as the selection of a colour, allow the retention means to be colour coded with regard to, for example, the particular location from which the load originates, a particular time at which the load has been formed and/or moved and/or a particular sector of workforce, with each sector being provided with retention means of different colours to use. In these embodiments, the aim is to allow a forensic analysis to be performed if, for example, a retention means, or a fragment thereof, is subsequently detected to be present in the foodstuff manufacturing process or foodstuff and thereby allow an indication of the time and/or location from which the contaminating retention means or fragment thereof, originates and thereby allows action to be taken to prevent a repeat occurrence.

In a further aspect of the invention there is provided a load of items, said load including a pallet base on which the items are stacked to define a load with a top wall, sidewalls and at least one retention means retains the said load of items in a defined position, said retention means provided to be located with respect to one or more walls of the said load of items and wherein the said at least one retention means include one or more materials as an integral part thereof which render the said retention means detectable by X-ray and/or metal detection apparatus when within a predetermined range of said apparatus so as to allow the presence of said retention means, or a fragment thereof greater than a predetermined size, to be detected.

In one embodiment the material from which the retention means is manufactured is or includes an antimicrobial feature.

In one embodiment the retention means is biodegradable.

Specific embodiments of the invention are now described with reference to the accompanying drawings wherein.

Figure 1:
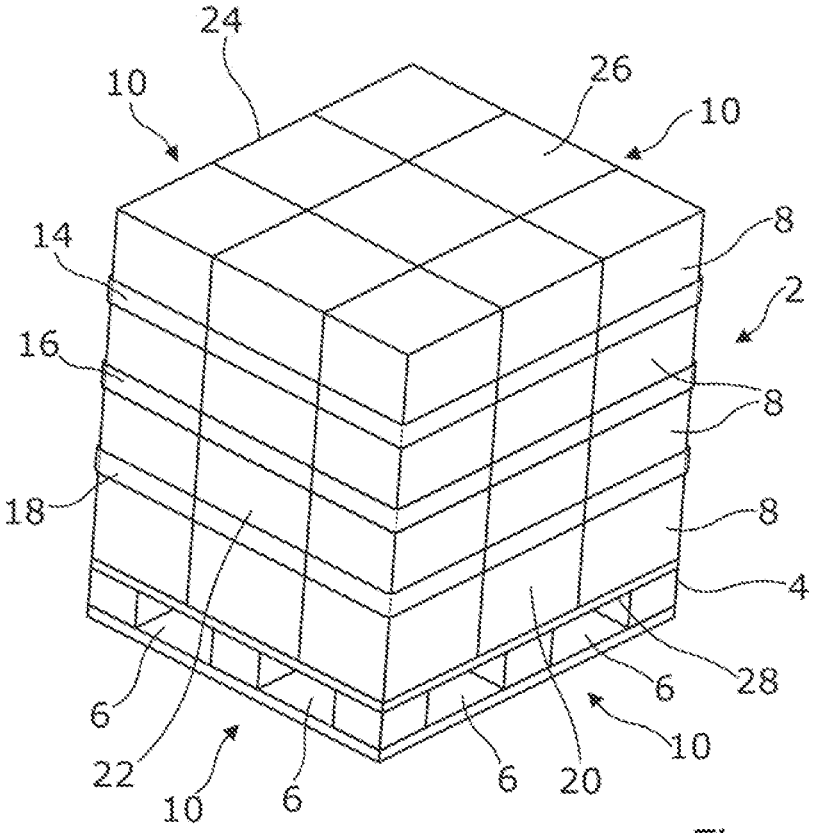
FIG. 1 illustrates a pallet load formed using a retention means in accordance with one embodiment of the invention.
Figure 2:
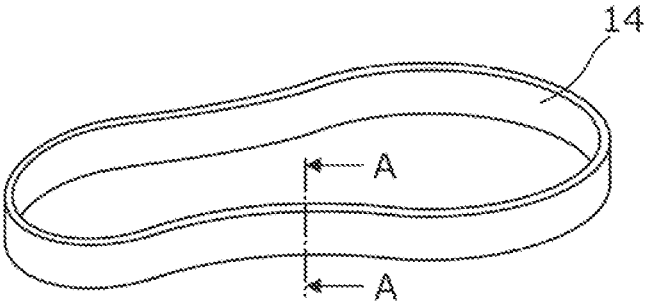
FIG. 2 illustrates a retention means in accordance with one embodiment of the invention.

Referring firstly to FIG. 1, there is illustrated a pallet load 2 formed in accordance with one embodiment of the invention.

In this embodiment, the pallet load 2 comprises a pallet 4 which forms the base of the load and which includes a series of location means 6 for the receipt of the prongs of a tail lift apparatus in a conventional manner so as to allow the load to be lifted and moved between different locations as and when required.

The remainder of the pallet load 2 is formed of a series of items stacked on the base and which in this case are packages of foodstuff containers, and each package 8 is placed in position with respect to the packages so as to form the overall pallet load 2 of the combination of packages 8 and which is typically cuboid in shape.

Whilst, at the time of placing the packages in position to form the pallet load the same can appear to be securely in position, it is found that during storage and/or movement, the packages 8 may move and the pallet load 2 become unstable and therefore in accordance with the invention, retention means, in this case in the form of three pallet bands 14, 16, 18, are placed at spaced intervals around the sidewalls of the load and act to provide a gripping force on the sidewalls 20, 22, 24, 26 as indicated by arrows 10 to effectively push opposing sidewalls towards each other and thereby act to maintain the pallet load in position, with the sidewalls 20, 22, 24, 26 being in a substantially vertical plane and perpendicular to the upper surface 28 of the pallet base 4. This therefore allows the load to be maintained as a unitary item during storage and/or movement.

In the example shown, each pallet band 14, 16, 18 is formed as a continuous band and may for example be formed of a silicone material so as to allow the same to be capable of being used in the food industry. It will be appreciated that at the time of delivery of the pallet load 2 to the end user, it will be necessary to separate the packages 8 and provide the same for the required use. It will also be appreciated that at this point, the pallet bands 14, 16, 18 also have to be removed and, whilst the intention is that these bands are reused, it is possible and especially in relatively pressurised, high throughput, environments, that the bands are discarded, or inadvertently lost, or are damaged so that there may be fragments of the band material present at the location of use of the containers. It will also be appreciated that if these containers are for use in the food industry, then the location at which this occurs, will be dose to the food manufacturing process and so the discarding of the bands and/or fragments of the same at this location thereby represents a risk that the same will enter the food manufacturing process and become a hazard to the end consumer of the food products.

Figure 3:
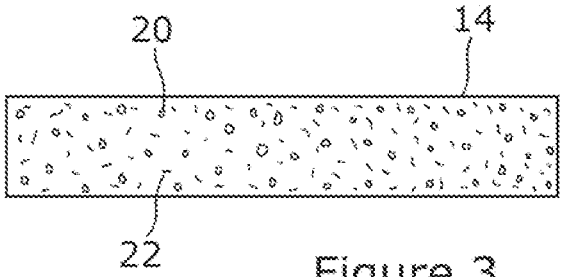
FIG. 3 illustrates a cross-section along line AA of the retention means of FIG. 2.

As a result, and in accordance with the invention, and as illustrated in FIG. 3, the band, in addition to being formed of silicone material and/or any other material which is required to provide the effective use of the same in retaining the load in position, also include one or more materials 20,22 which allow the bands and fragments thereof to be metal detectable and/or X-ray detectable.

Typically, the X-ray and metal detection will occur using apparatus which is provided on the food production line and most typically, near the end of the same and thereby any band or fragment thereof, which has inadvertently entered the food production process of foodstuff itself, can now be identified as a result of the provision of the material which allows the same to be metal and/or X-ray detectable.

Typically, the same can be rendered metal detectable by the inclusion therein of a quantity of metal particles 20 with the particular metal which is selected, being one which is found to be particularly effective at being detected and suitable for use with metal detection apparatus and the particles are typically provided in the material used to form the band at the time of formation of the band so that typically the metal particles are dispersed into the silicone material used to form the band when the same is in a liquid state and thereby ensure relatively even dispersal of the metal particles and at a required density throughout the material.

Alternatively, or in addition, the material used to form the retaining band can also include a material therein such as barium 22, which is capable of rendering the pallet band detectable by X-ray apparatus and once again the material is added at the time of formation of the band so as to form an integral part of the same.

Typically, if the colour of the band is important for the use of the same for the purposes as previously described, the selected colour pigment is also added to the material at the time of manufacture of the band so that the same has the required colour.

The invention claimed is:

1. A retention means for use in retaining a load of items in a defined position, said retention means provided to be located with respect to one or more walls of the load of items and the retention means include one or more materials as an integral part thereof which render the retention means detectable by an X-ray and/or a metal detection apparatus when within a predetermined range of said apparatus so as to allow the presence of said retention means, or a fragment thereof greater than a predetermined size, to be detected, wherein the retention means are provided in the form of a band of a flexible material and selectively positioned with respect to a plurality of said one or more walls of the load of items so as to exert a retaining force on said walls.

2. A retention means according to claim 1 wherein the material includes particles of a metal or a metal alloy of a form which is detectable by the metal detection apparatus.

3. A retention means according to claim 1 wherein said material includes barium to render the retention means capable of detection by the X-ray detection apparatus.

4. A retention means according to claim 1 wherein the X-ray and/or metal detectable materials are located and mixed within the retention means at a time of forming the retention means.

5. A retention means according to claim 1 wherein a density of said metal and/or X-ray detectable material which is included in the retention means is selected with respect to the predetermined size of fragment of the retention means which is desired to be detectable when within a predetermined size when in a predetermined range of the detection apparatus.

6. A retention means according to claim 1 wherein the predetermined size is 1 $cm^2$ and the predetermined range of said apparatus is up to 1 metre from the X-ray and/or metal detection apparatus.

7. A retention means according to claim 1 wherein the walls are sidewalls of the load of items such that the retention means act to retain the sidewalls in substantially vertical planes during storage of the load of items and/or movement of the load of items between different locations.

8. A retention means according to claim 1 wherein the load of items is located on a pallet.

9. A retention means according to claim 1 wherein the retention means engage with a pallet and at least one wall of the load of items.

10. A retention means according to claim 1 wherein a range of retention means sizes are available for selection and use to retain a load of a particular dimension.

11. A retention means according to claim 1 wherein the retention means have a degree of elasticity and resilience such that the same can be extended to a size to allow the same to be positioned with respect to said load of items and, when in position, release of the retention means allows the band to decrease in size and exert a retaining force on the load of items.

12. A retention means according to claim 1 wherein the retention means include an indication means, and selection of the indication means used on a said retention means is made with reference to, use of the retention means, user of the retention means, level of detectability of the retention means such that the indication means selected distinguishes the retention means from other retention means.

13. A retention means according to claim 12 wherein the indication means is used to indicate whether the retention means or said fragment thereof is detectable by the metal detection apparatus, the X-ray detection apparatus or by the X-ray and metal detection apparatus.

14. A retention means according to claim 12 wherein the indication means are in the form of one of a range of colours or a mixture of colours which are matched to a table indicating a characteristic attributed to each colour or mixture of colours.

15. A retention means according to claim 12 wherein the indication means are matched to a particular worker, workforce or shift of workers so as to allow forensic analysis to be performed to identify an origin of a detected retention means or fragment thereof.

16. A retention means according to claim 1 wherein the retention means are manufactured from or include an antimicrobial material.

17. A retention means according to claim 1 wherein the retention means is formed from a biodegradable material.

* * * * *